US009533796B2

(12) United States Patent
Selina et al.

(10) Patent No.: US 9,533,796 B2
(45) **Date of Patent: *Jan. 3, 2017**

(54) COLLAPSIBLE SPOUT FOR A CONTAINER AND METHOD OF MANUFACTURE THEREOF

(75) Inventors: John R. Selina, Brighton, MI (US); Randall J. Corbett, Macomb, MI (US)

(73) Assignee: Letica Corporation, Rochester, MI (US)

( * ) Notice: Subject to any disclaimer, the term of this patent is extended or adjusted under 35 U.S.C. 154(b) by 1156 days.

This patent is subject to a terminal disclaimer.

(21) Appl. No.: 13/048,986

(22) Filed: Mar. 16, 2011

(65) Prior Publication Data

US 2012/0085793 A1 Apr. 12, 2012

Related U.S. Application Data

(63) Continuation-in-part of application No. 12/898,768, filed on Oct. 6, 2010.

(51) Int. Cl.

| | |
|---|---|
| ***B67D 3/00*** | (2006.01) |
| ***B67D 7/06*** | (2010.01) |
| ***B65D 25/44*** | (2006.01) |
| ***B65D 47/06*** | (2006.01) |

(52) U.S. Cl.
CPC ..... *B65D 25/44* (2013.01); *B65D 47/063* (2013.01)

(58) Field of Classification Search
USPC ..... 222/570, 530, 527, 566, 567, 569
See application file for complete search history.

(56) References Cited

U.S. PATENT DOCUMENTS

| | | | | |
|---|---|---|---|---|
| 1,804,627 | A * | 5/1931 | Lukenbill | 215/363 |
| 3,580,427 | A | 5/1971 | Clarke | |
| 4,073,413 | A * | 2/1978 | Tabler et al. | 222/529 |
| 4,403,709 | A * | 9/1983 | Meins et al. | 220/703 |
| 4,428,507 | A | 1/1984 | Sneider | |
| 4,602,728 | A * | 7/1986 | Ha | 222/528 |
| 4,921,147 | A * | 5/1990 | Poirier | 222/527 |
| 5,230,442 | A * | 7/1993 | Dean, Jr. | 222/108 |
| 5,722,570 | A * | 3/1998 | Sultzer et al. | 222/529 |
| 5,799,813 | A | 9/1998 | Letica | |
| 5,913,460 | A * | 6/1999 | Arciniegas | 222/530 |
| 5,967,376 | A * | 10/1999 | McLelland et al. | 222/153.06 |
| 5,975,380 | A | 11/1999 | West, Jr. | |
| 6,435,384 | B1 * | 8/2002 | Davis et al. | 222/529 |
| 6,641,007 | B2 * | 11/2003 | Chung et al. | 222/529 |
| 2004/0188474 | A1 | 9/2004 | Johnston Wills | |
| 2007/0056996 | A1 * | 3/2007 | Zijing et al. | 222/530 |
| 2008/0029559 | A1 * | 2/2008 | Selina et al. | 222/570 |
| 2011/0114679 | A1 * | 5/2011 | Park | 222/528 |

* cited by examiner

*Primary Examiner* — Paul R Durand
*Assistant Examiner* — Jeremy W Carroll
(74) *Attorney, Agent, or Firm* — Young Basile Hanlon & MacFarlane, P.C.

(57) ABSTRACT

The combination of molded plastic closure for an open top container and an extensible plastic spout adapted to be joined to the deck of the closure in either of two ways. In one way, the spout is molded with a U-shaped peripheral channel which receives a downwardly extending flange surrounding an aperture in the deck. In another way, the spout is pre-molded and then used as an insert when molding the closure.

6 Claims, 7 Drawing Sheets

COLLAPSIBLE SPOUT FOR A CONTAINER AND METHOD OF MANUFACTURE THEREOF

CROSS-REFERENCE TO RELATED APPLICATION

This application is a continuation-in-part of the co-pending U.S. patent application Ser. No. 12/898,768 filed Oct. 6, 2010 and assigned to Letica Corporation of Rochester, Mich. The entire content of the aforesaid parent application is incorporated herein by reference and a claim of priority is made thereto.

FIELD OF THE INVENTION

This invention relates to collapsible spouts for closures used in combination with open top industrial containers.

BACKGROUND OF THE INVENTION

It is known to install collapsible, but manually extensible, spouts in the closure decks of industrial containers for the purpose of facilitating the act of pouring out the contents of the container. One common spout uses a "roll sock" configuration wherein the soft plastic body of the spout is gradually turned inside out as the spout is extended. Roll sock spouts typically have three pieces and are of limited height.

SUMMARY OF THE INVENTION

The present invention provides an improved spout for use in combination with closures of the type used for industrial shipping containers. In general, the spout of the present invention comprises a plastic body having a plurality of molded-in concentric pleats generally characterized by thinner cross-sectional areas at the annular hinge points. At the outlet end of the spout; i.e., the end which, in the extended condition, is farthest from the closure, features such as threads or annular ridges are molded into the spout collar to receive a cap which, when the spout is in the collapsed or folded condition, is normally substantially flush with the top surface of the closure deck.

In one embodiment, the other end of the spout; i.e., the larger diameter or "inlet" end, is characterized by a U-shaped channel which is designed to accept in complemental locking engagement therein, a downwardly extending annular flange which is an integral part of the closure deck and defines a circular opening therein. Thus, the spout can easily be snapped into engagement with the closure deck from the underside of the deck surface.

In another embodiment, the larger end of the spout body is insert-molded into the closure itself so as to be essentially an integral part thereof.

In the preferred embodiment described herein, a pull-ring is formed integrally with the cap and around the periphery thereof so that a person may grasp the pull-ring with two or more fingers, lift it up and away from its resting plane and exert an upward pressure on the spout through the cap so as to extend the spout into a stable partially or fully extended condition.

Also in the preferred embodiment hereinafter described in detail, a seal with a pull-ring is formed integrally inside of the spout collar so as to protect the contents of the container until such time as one desires to deploy the spout and gain access to such contents.

According to another aspect of the invention, the pleated body of the spout is molded in the collapsed condition with all of the pleats of the body as well as the outlet collar concentrically within one another in essentially the same plane.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENTS

Figure 1:
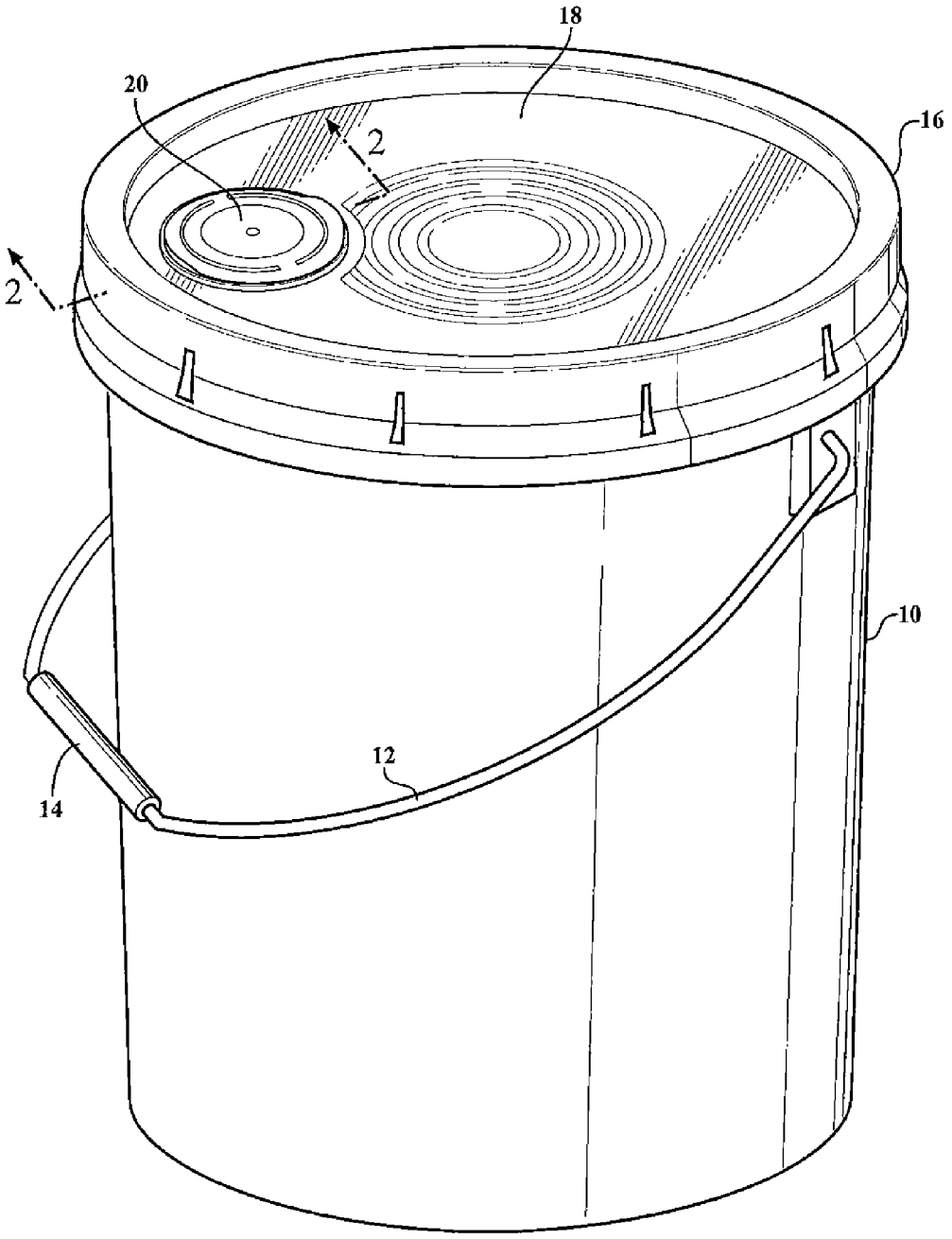
FIG. 1 is a perspective view of a container comprising a lock-on closure equipped with a collapsible spout in accordance with a first embodiment of the invention.
Figure 2:
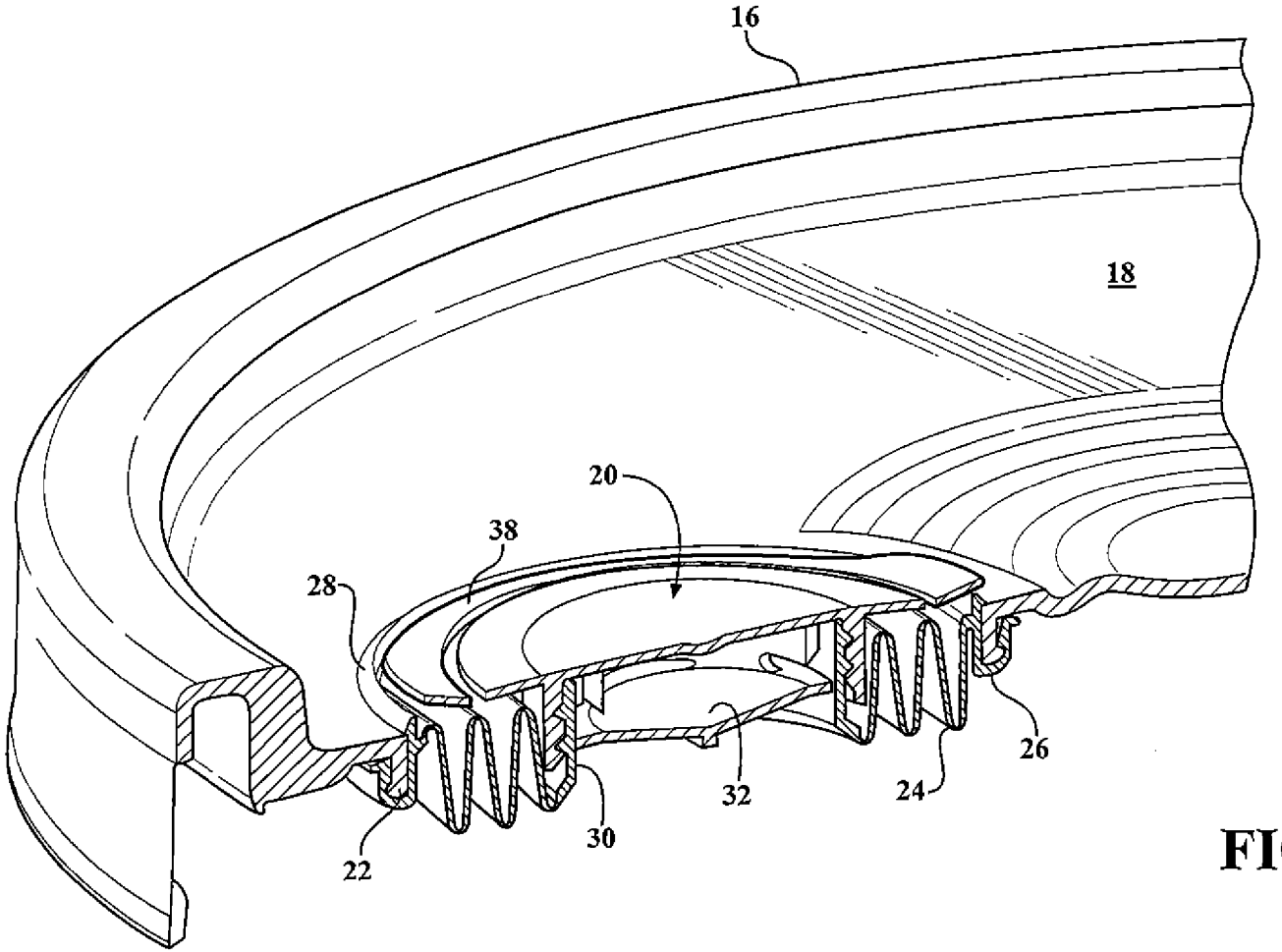
FIG. 2 is a perspective view partly in section showing the construction of the spout and the closure deck in which the spout is mounted.
Figure 3:
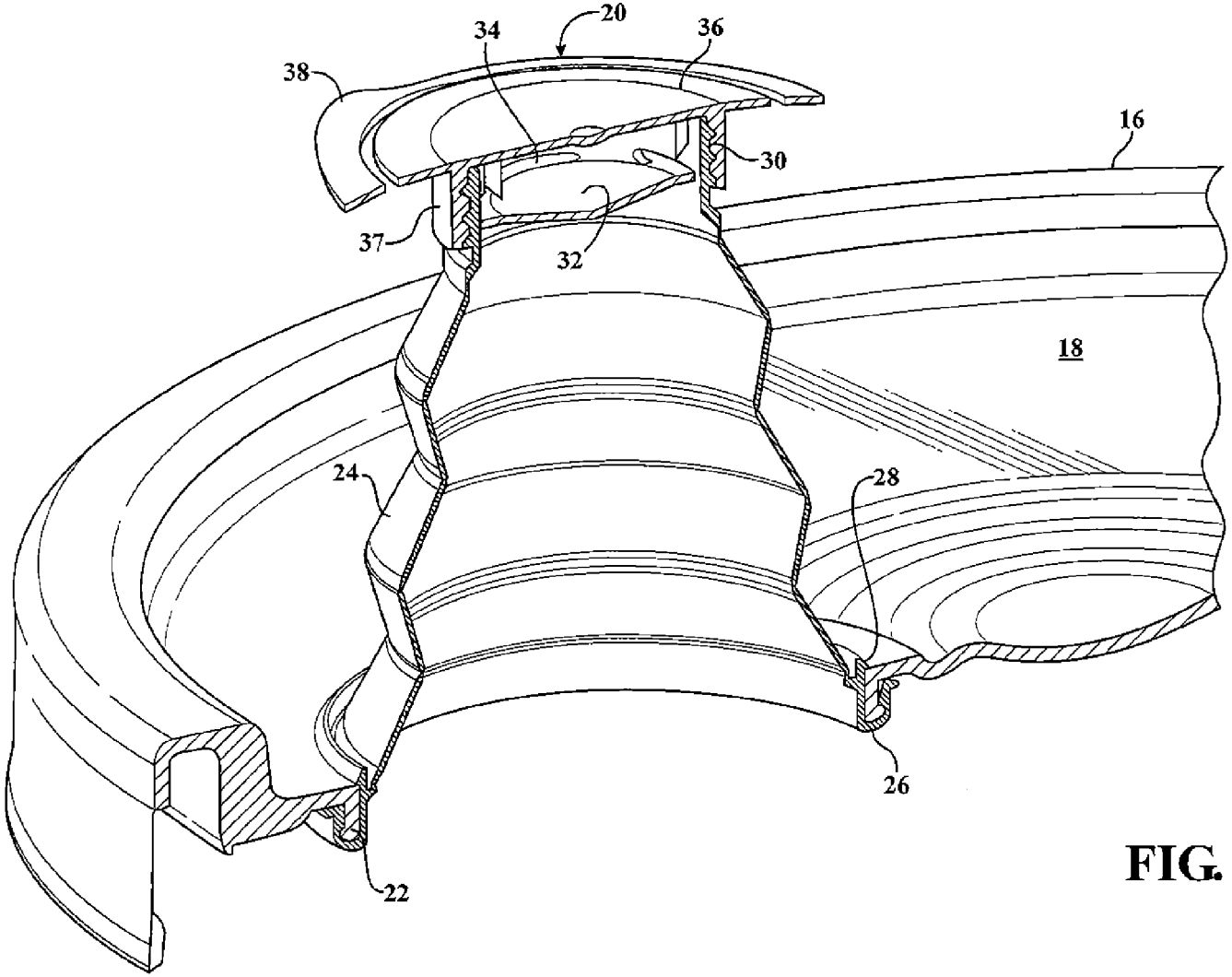
FIG. 3 shows the spout of FIG. 1 in an extended condition.

Referring to FIGS. 1 through 3, a five-gallon open-top molded container 10 is shown to be equipped with a bail 12 having a handle 14. The open top (not shown) of the container 10 is sealingly closed by a molded plastic closure 16 of well known design. Both the container 10 and the closure 16 are often and advantageously injection molded of high-density polyethylene; however, many other materials of construction may be used. The size of the container is given by way of example only.

The closure 16 is characterized by a generally flat central deck 18 having formed therein a circular opening which receives therein a two-piece spout assembly 20. The opening in the deck has a downwardly (or inwardly, relative to the interior of the container 10) extending flange 22 with an annular detent head for purposes to be described.

The spout assembly 20 comprises a molded plastic, concentrically-pleated spout body 24 which is molded with the pleated portions thereof concentric and in the collapsed condition shown in FIG. 2. The body of the spout has a large diameter inlet end 26 with a U-shaped peripheral channel adapted to lockingly receive the inwardly extending flange 22 of the closure deck 18 such that the spout is installed from the interior or underside of the closure deck; i.e., the spout 24 is inserted from the underside or bottom of the deck 18 and pushed upwardly into locking engagement with the flange 22. A peripheral flange 28 on the top of the U-shaped channel 26 seats against the top of the deck 18 just around the outside of the circular opening to provide a seal.

The smaller diameter or outlet end of the spout body is defined by a generally cylindrical collar 30 having external spiral threads formed thereon to receive a cap 36 which forms the second component of the spout assembly. The cap 36 comprises a cylindrical body portion 37 with internal threads to mate with the external threads of the collar 30. The cap 36 is equipped with an integral pull-ring 38 around the outer periphery thereof to exhibit the largest possible diameter. The pull-ring 38 is partially separated from the cap body by a circular gap or slot so that the pull-ring may be lifted and grasped in the hand when one wishes to extend the spout. In short, the spout is extended by grasping the pull-ring 38 with the cap 36 attached to the collar 30 and pulling upwardly until the pleats begin to unfold into any of various stable configurations.

A secondary seal 32 is formed integrally within the collar 30 and has its own pull-ring 34 in conventional fashion for selective removal when one wishes to deploy the spout and gain access to the contents of the container.

In a practical embodiment, the circular opening in the deck 18 is on the order of three inches in diameter and the remaining components of the assembly as shown in the Figures are scaled according to that dimension. It is apparent from FIGS. 2 and 3 that the pleated spout exhibits a large extension height thus making the act of pouring from the container 10 easier and less likely to produce spills.

Figure 4:
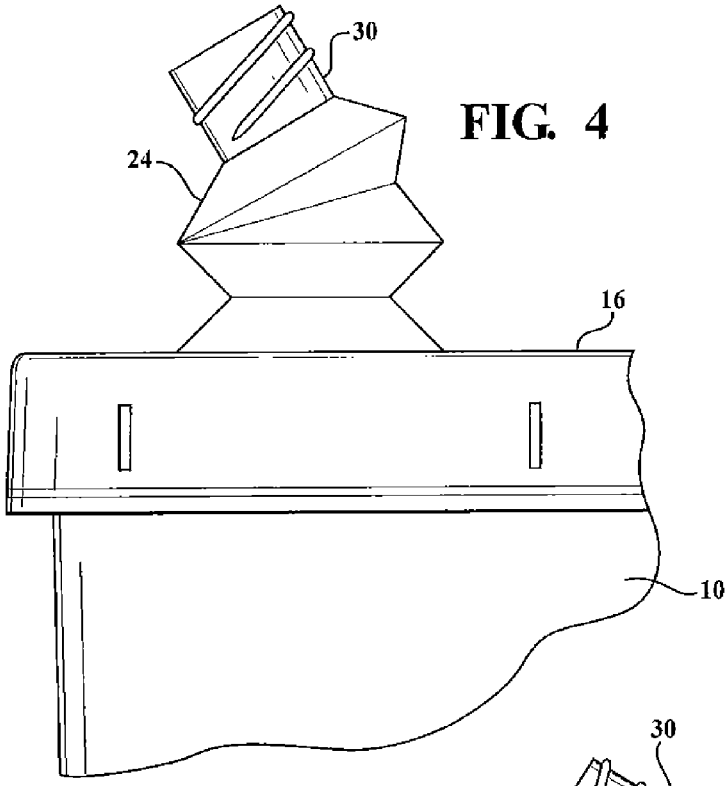
FIG. 4 is a side view of the spout showing how it can be asymmetrically extended.
Figure 5:
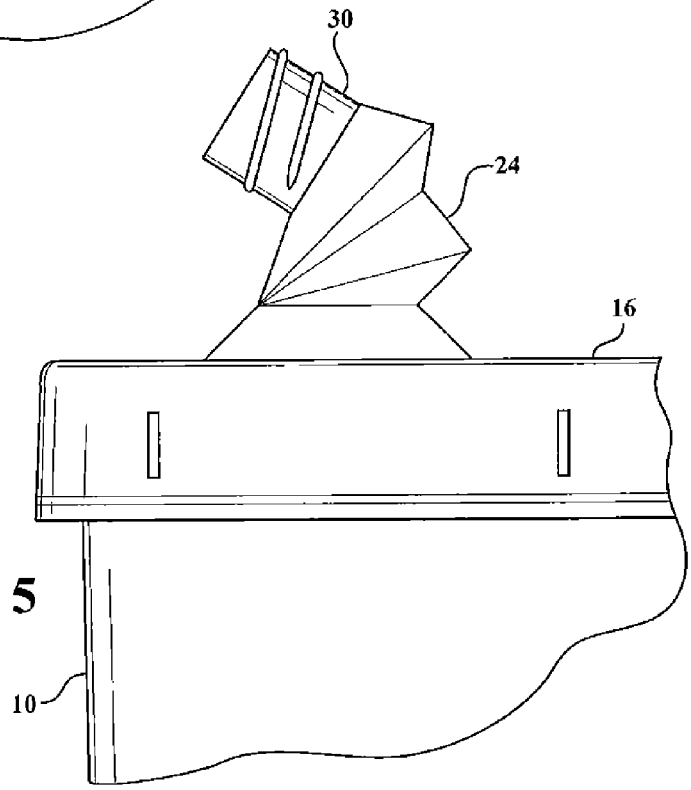
FIG. 5 is another view showing an asymmetric extension of the spout.

As shown in FIGS. 4 and 5, the spout 24 can be extended symmetrically and asymmetrically; i.e., the latter being characterized by a greater degree of pleat extension on one side of the spout than on the other thus to place the spout 24 in a "cocked" condition. The material of the body 24 is thinner at the pleats to provide an "over-center" release as each pleat is unfolded. Moreover, the fact that the spout body 24 is molded in the collapsed condition provides a "memory" function which assists in returning the spout from the extended position to the collapsed condition within the opening in the closure deck 18.

The method of the present invention comprises, overall, the steps of providing a mold which affords the appropriate design for the spout, and molding the spout in the collapsed condition with the pleats and the collar 30 concentric and essentially monoplanar. The mold is such as to create the thin cross-sections at the pleat hinge points as can be seen in FIGS. 2 and 3.

Figure 6:
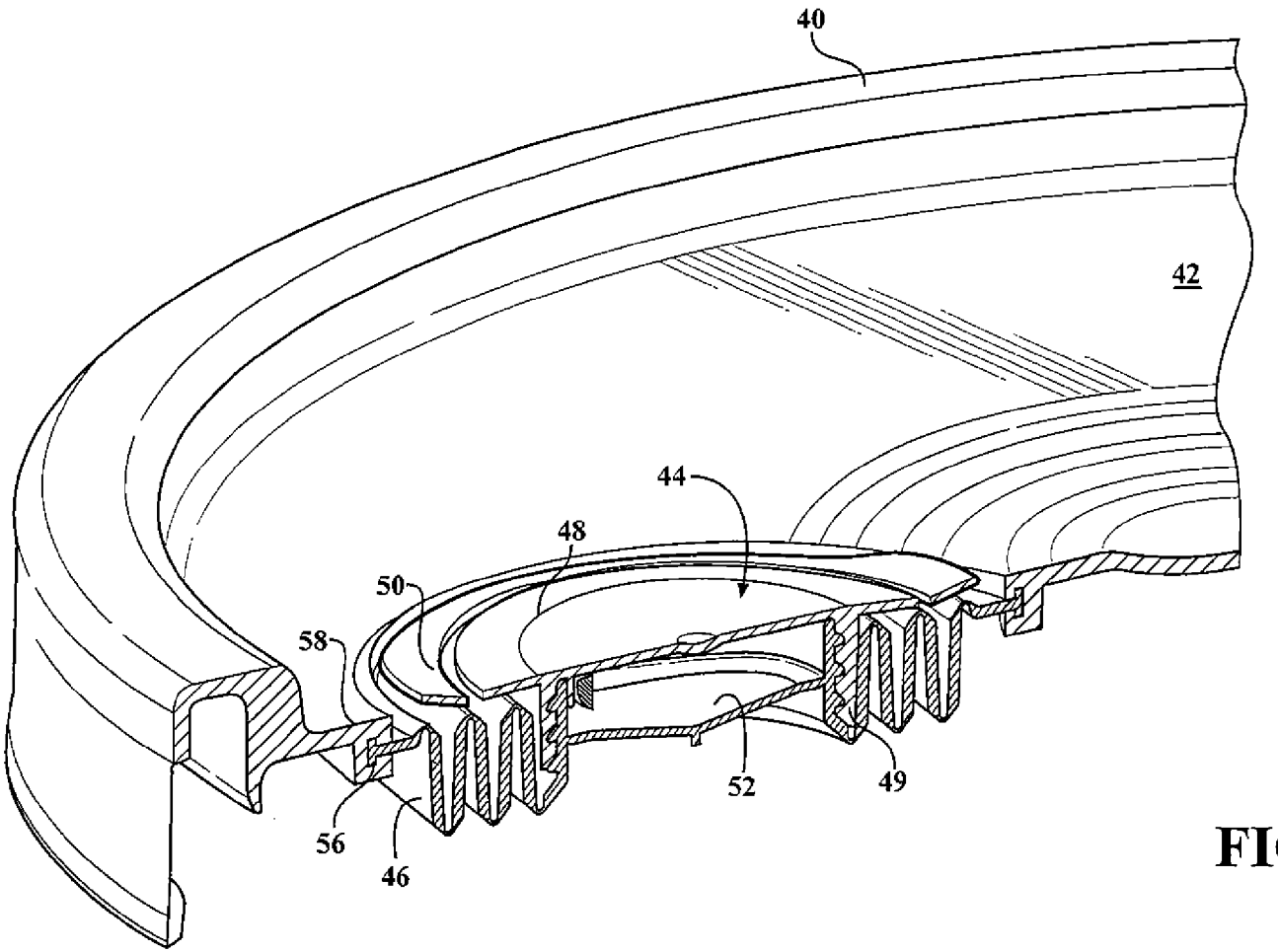
FIG. 6 is a perspective view of a closure showing a second embodiment of the invention.
Figure 7:
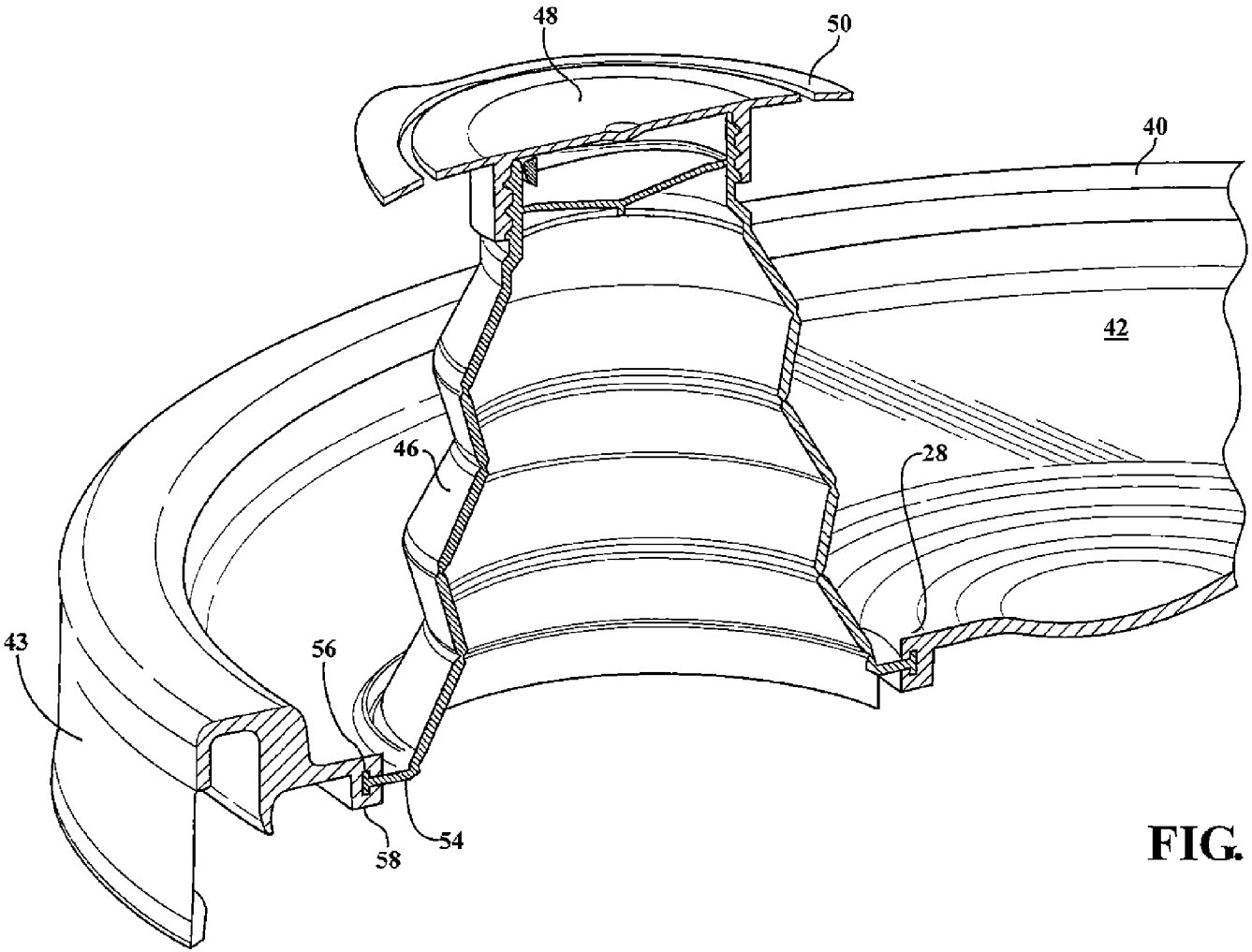
FIG. 7 is a perspective view of the spout of FIG. 6 in an extended condition.

Referring to FIGS. 6 and 7, a second embodiment of the invention is shown to comprise a molded polyethylene closure 40 having a substantially planar central deck portion 42 bounded by a peripheral portion defining an inverted U-shaped channel for receiving the top flange of a container such as container 10 shown in FIG. 1. A spout assembly 44 comprising a pleated collapsible spout body 46 and a screw-on cap 48 having an integral pull-ring 50 is also illustrated. The cap is attached to the outlet end of the spout body 46 by way of threads 49 which may also take the form is one or more non-helical ridges to receive and hold the cap 48. In the embodiment of FIG. 6, the larger diameter inlet end of the spout body 46 is terminated in a flange 54 having a T-shaped annular terminal portion 56 formed integrally therewith. Again, the preferred material of construction may be high-density polyethylene but other polymeric materials can also be used.

Figure 8:
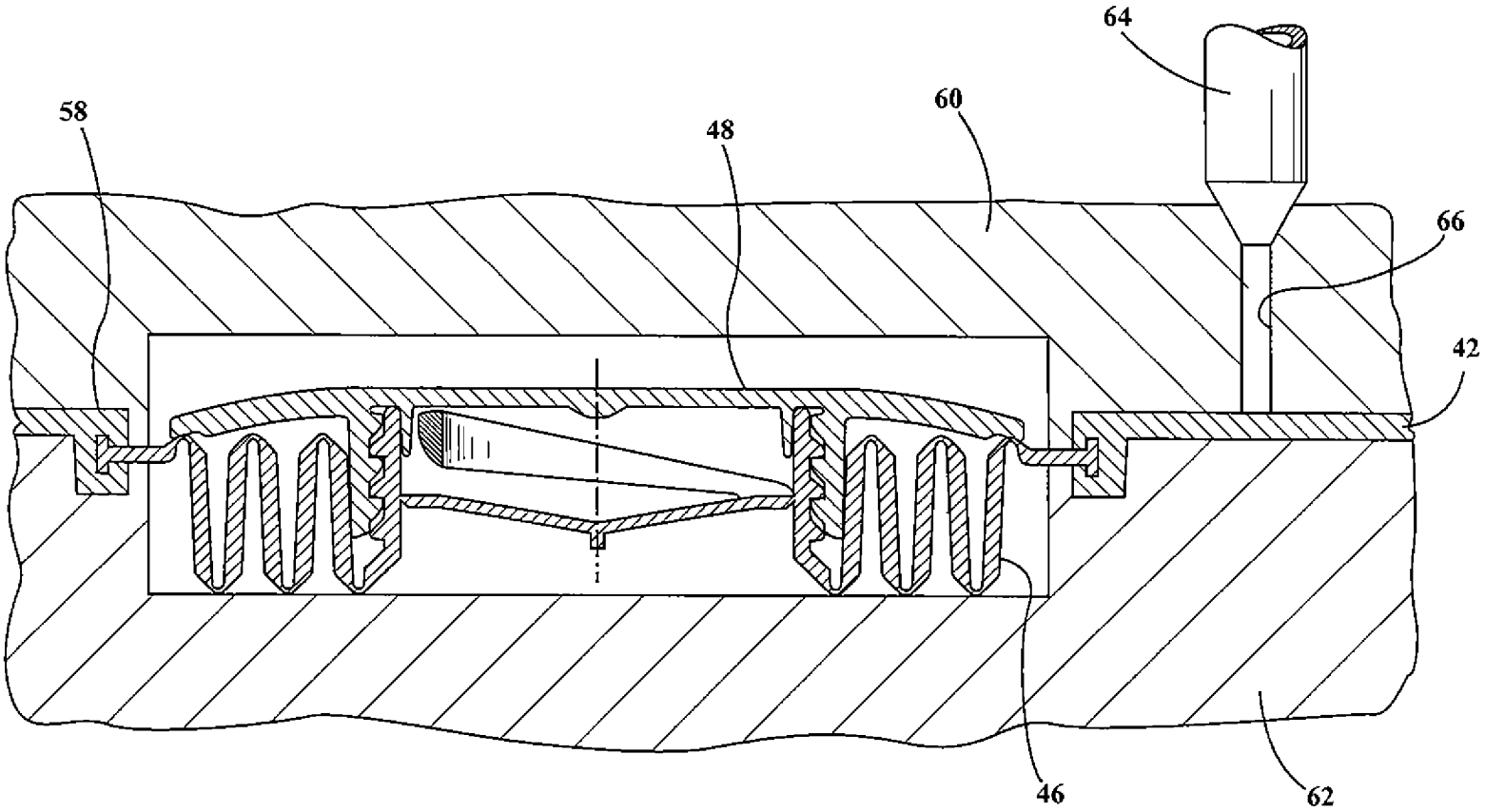
FIG. 8 is a sectional view of the embodiment of FIG. 6 undergoing an insert-molding process in a mold.

Whereas the embodiment of FIGS. 1-5 involves attaching the separately molded spout to the downwardly extending flange 22 of the separately molded closure 16, the closure 40 in FIGS. 6 and 7 is molded to and around the flange 54 of the spout 46 in an "insert molding" process step where, as best shown in FIG. 8, the apparatus comprises upper and lower mold body portions 60, 62, a plastic injector 64 and a sprue 66 for allowing molten plastic to enter the cavity which forms the closure deck 42 and an annular portion 58 having a generally square cross-section which surrounds the T-shaped appendage 54 on the outer edge of the spout inlet. Thus, the closure 40, 42 is, therefore, molded with the spout 46 as if it were a single piece and no separate attachment step is needed. The closure 40, 42 emerges from the mold 60, 62 as a unitary pre-assembly ready to install or ship to the installation point.

Again, the pleat hinge points are thinner in cross-section than the remainder of the spout body 46 to give the hinge areas greater bending capability and to provide a memory function when returning the spout to the collapsed position shown in FIGS. 6 and 8.

What is claimed is:

1. A closure having a manually operable plastic spout attached thereto and extendable along an extension axis comprising:

a molded plastic closure having a deck with an inwardly flanged cylindrical opening formed therein;

an extendable plastic spout molded into a stable collapsed condition and comprising an integrally continuous plurality of annular wall sections of substantially equal thickness, rigidity and axial length, but of progressively smaller diameter interconnected by hinges of thinner, more flexible construction than said wall sections; said wall sections in the collapsed condition, laying concentrically within one another within said flanged opening wherein, when said spout is fully collapsed, the top edges of the collapsed sections lie substantially in a common plane perpendicular to the extension axis;

a neck section integral with said plurality of annular wall sections and within the innermost of said wall sections and opening inwardly toward said flanged opening but being more rigid than said plurality of wall sections, said neck section having external threads formed thereon; said sections being extendible in sequence by over-center action but having a memory quality to return to the collapsed condition;

a cap having a cylindrical neck portion and a larger diameter planar top portion, said neck portion having threads mating with the external threads of the innermost spout section to close the spout, the planar top portion lying substantially immediately above said common plane when the spout is in the collapsed condition; and an annular pull ring formed integrally with the top portion of the cap and in circumferentially surrounding relationship therewith; said pull ring being radially separated from said cap planar top portion by two circular slots but integrally joined with top portion by two radially extending tab portions such that the pull ring may be lifted out of the plane of the top portion and used as a grip to pull said spout to an extended pull condition;

said cap top portion and said pull ring together being of sufficient diameter to substantially fill the cylindrical flanged opening in said closure deck and create a substantially flush deck structure; and said spout being permanently attached to said closure by insert molding.

2. The closure as defined in claim 1 wherein the hinges have cross-sectional dimensions which are less than the cross-sectional dimensions of said sections.

3. The closure defined in claim 1 wherein the spout is molded in the collapsed condition such that extension produces an over-center inversion of every other section to reconfigure the spout from a stable collapsed condition to a stable extended condition.

4. The closure defined in claim 3 wherein all of the sections in the stable collapsed condition lie parallel to the extension axis.

5. The closure defined in claim 1 wherein the spout includes a grooved outermost annular section that is snap-fit into the closure opening flange.

6. A method of making a closure with an integral extendable plastic spout comprising the steps of:

a. molding a plastic spout in a stable, memorized collapsed configuration characterized by a plurality of concentric annular ring sections of substantially equal thickness and stiffness equally joined by thinner integral hinges wherein the tops of the sections, in the molded, memorized collapsed configuration, are essentially coplanar and the molded collapsed spout has a circumferential flange; said molded spout further having a rigid neck section integral with an innermost ring section and extending upwardly to an open top which, in the molded configuration, is coplanar with the top of said ring sections and is externally threaded; and b. molding a closure having a deck portion with a circular opening wherein the circumferential flange of the spout is used as an insert which is permanently joined to the plastic material of the molded deck by molding the material of the deck around the flange of the spout whereby the thinner integral hinges, in combination with the thicker concentric annular ring sections, create a sequential over-center action between said ring section during extension of said spout from the collapsed configuration.

* * * * *